US006695019B2

(12) United States Patent
Hasenkopf

(10) Patent No.: US 6,695,019 B2
(45) Date of Patent: Feb. 24, 2004

(54) COMBO VENDING SYSTEM FOR GASES

(76) Inventor: Karl-Peter Hasenkopf, Ohmstrasse 10, 92521 Schwarzenfeld (DE)

( * ) Notice: Subject to any disclaimer, the term of this patent is extended or adjusted under 35 U.S.C. 154(b) by 0 days.

(21) Appl. No.: 10/109,619

(22) Filed: Mar. 28, 2002

(65) Prior Publication Data

US 2003/0075236 A1 Apr. 24, 2003

(30) Foreign Application Priority Data

Mar. 28, 2001 (DE) ..... 101 15 334

(51) Int. Cl.[7] ..... B65B 1/04

(52) U.S. Cl. ..... 141/98; 141/2; 141/9; 141/18; 141/104

(58) Field of Search ..... 141/2, 9, 18, 98, 141/100, 104, 231

(56) References Cited

U.S. PATENT DOCUMENTS 5,427,160 A * 6/1995 Carson et al. ..... 141/4
5,954,099 A * 9/1999 Princiotta et al. ..... 141/18
6,394,151 B1 * 5/2002 Donaldson et al. ..... 141/99

* cited by examiner

*Primary Examiner*—Steven O. Douglas
(74) *Attorney, Agent, or Firm*—Kriegsman & Kriegsman

(57) ABSTRACT

A vending system (1, 1*a*) for gases and a method for distributing gases using a vending system. The vending system includes a filling station (12) for filling gas bottles (2) with at least one gas, with at least one gas supply means (3) connected to the filling station (12) and control means for control of a gas distribution, which is characterised in a filling mechanism further provided for filling vehicle gas tanks, and which is likewise connected to the at least one gas supply means (3) and which is also controlled by the control means.

20 Claims, 2 Drawing Sheets

COMBO VENDING SYSTEM FOR GASES

Figure 1:
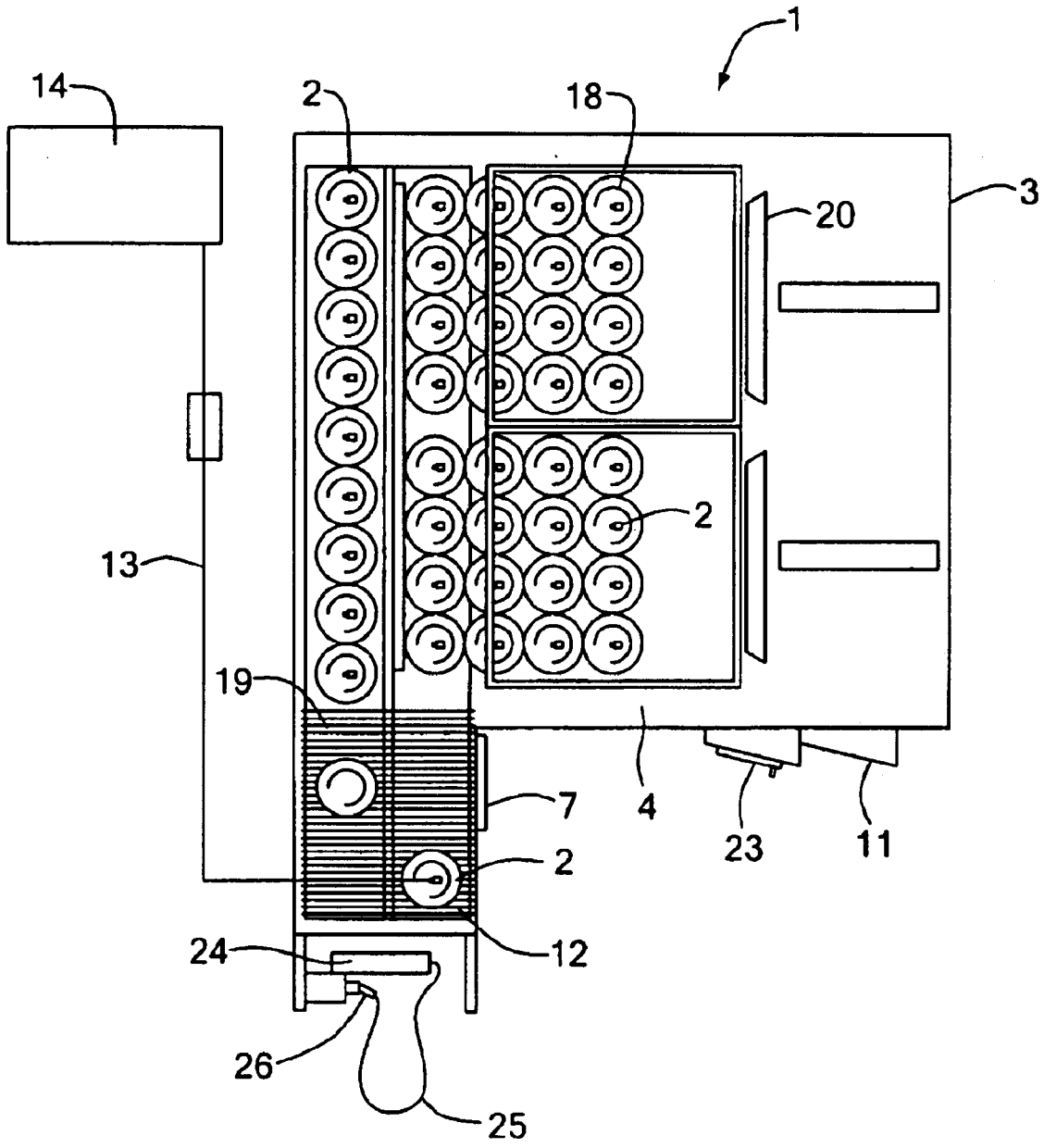

The present invention relates to a vending system for gases and a method for the distribution of gases using a vending system.

Vending systems for gases in gas bottles are known from the prior art. Such systems are described, for example, in DE 1 965 2147 and similar. They involve the use of filling stations at which empty gas bottles can be refilled or exchanged for filled gas bottles.

The known vending systems of this kind are specialised arrangements associated with high costs and are designed for the sole purpose of selling gas in bottles. They include not only complex mechanical and safety-sensitive gas devices such as pipes, tanks and electrical valves but also a control for the actual vending process, which is wired to the other components. A reading device for cash or credit cards may also be provided as well as a mechanism for cash payments.

The object of the present invention is therefore to improve the benefit to the customers without significantly increasing the cost of the overall installation.

This object is resolved by the provision of a vending system for gases in accordance with independent claim 1 and the method for the sale of gases in accordance with independent claim 14. Further advantageous embodiments, aspects and details of the present invention may be deduced from the dependent claims, the description and the attached drawing.

In addition to the sale of gas bottles, the principle underlying the invention consists in the provision of devices by which gas tanks in vehicles may be refilled. The technical integration and combination of these two functionalities enables the creation of a considerably more attractive vending point, whose production costs are not significantly higher than those of a vending system purely for gas bottles due to the parallel utilization of components.

In consequence, the invention is directed to a vending system for gases with a filling station for filling gas bottles with at least one gas, at least one gas supply line connected to the filling station and control means for controlling gas distribution, which is characterised in that a filling device is further provided for the filling of gas tanks in vehicles, and which is also connected to the at least one gas supply line, and which is likewise controlled by the control means.

The filling station used in accordance with the invention may be any filling station for gas bottles known from the prior art. In particular, it may be a simple filling station for bottles brought by customers, but may also be a filling station in combination with a return system, in which for example the customer may choose (or the vending system decides on the basis of predetermined criteria), whether an empty bottle is to be refilled or a new, filled gas bottle is to be issued from a reservoir.

The filling device for gas tanks in vehicles provided according to the invention shares the use of as many as possible of the components provided for the filling station. In particular these two components share the gas supply line, or lines if more than one and possibly different gases are to be sold, as well as the means for controlling the dispensing of the gases.

Various options for implementing the gas supply are available. Accordingly, for example, the gas supply may be a gas tank that is connected to the filling station, or a gas pipe which connects the vending system to a main gas provider.

The filling device may preferably be furnished with:

a flow control unit connected to the gas supply and the control means, a supply connected to the flow control unit, and a filler pipe connected to the supply, which pipe is adapted to fit an inlet valve on the gas tank of a vehicle; the vehicle gas tanks in question may be the fuel tank for the vehicle engine, but equally the heating tanks, for example in the case of caravans.

The filler pipe should be a system that is commonly available and can be connected to the gas tanks by the customer, for example a manually operated bayonet system.

The supply line may be a hose suitable for transporting gas. It may also be a solid pipe supply line, provided it is capable of being moved so that a connection can be made with the gas tank of the vehicle to be filled. Combination supply lines consisting of a section of pipe and a section of hose, are also intended for inclusion in this arrangement.

The flow control unit regulates the inflow of the gas from the gas supply into the tank of the vehicle to be filled. It comprises a controllable valve, which can be operated by the control means on the vending system, as well as other elements as required such as a flow rate meter and a pressure sensor.

The control means may comprise a microcontroller that is connected to the main part of the vending installation by sensors and actuators. Operation may be effected via an operating device, with which the customer may make various selections, such as filling bottles or vehicle tanks.

As has been indicated in the foregoing, in addition to a mere filling station, the vending system may comprise additional elements for handling bottles. Thus, it may also be equipped with a reservoir for gas bottles, from which the gas bottles may be withdrawn under access control, and/or to which the gas bottles may be returned, preferably under access control.

This bottle reservoir can have different functions for handling gas bottles. For example, prefilled bottles may be made available, for example in exchange for empty bottles returned by the customer, it may accept and provide temporary storage for the empty bottles, and it may, for example, remove defective bottles from circulation and store those also.

At least one sensor is preferably provided for controlled access to the reservoir and/or to the filling station, which sensor cooperates with a bottle identification means on the bottle, for example a chip, a transponder, or with a bar or color code on the bottle and/or an image recognition device is provided. This allows handling of the gas bottles to be improved, since it enables a simple typing of the bottles and thereby also a more precise response to customers' wishes. In this way it is possible to avoid filling bottles that are either the wrong size or type, or receiving or filling bottles from another gas distribution organisation.

Preferably, the filling station is located outside the reservoir. This improves access and represents a security measure.

The reservoir may be configured to accommodate at least one method of disposing gas bottles for transport and provided with means for removing gas bottles from and/or returning them to the disposal means.

Preferably, the disposal means consists of pallets, magazines, containers or container-like devices.

In the reservoir, a reception system may be provided having a plurality of reception stations, each for one gas bottle, wherein each reception station may be moved to an issue and/or a return station for a gas bottle.

The invention may be further characterised in that the control means may or does control at least one issue and one return station.

Preferably, means are provided for automatic filling of the bottles in order to reduce effort of operation and to prevent operating errors during filling.

The invention is further directed to a method for selling gases with a vending system with a filling station for gases, and with a filling apparatus for filling the gas tanks of vehicles, including the following steps:

determine whether a customer wants to buy gas in bottles or gas for a tank;

if the customer wants to buy gas for a vehicle tank:

fill the vehicle tank up to a technical limit or up to a predetermined amount;

if the customer wants to buy gas in gas bottles:

issue a filled gas bottle.

Everything that has been stated with reference to the device according to the invention also applies in the same sense to the method according to the invention, so that the device is implied in all points though only the method is expressly described.

The customer's wishes are determined for example by analysis of inputs, which the customer can make, for example, at an operation unit for the control means.

With the method according to the invention, the technical limit may be a permissible gas pressure in the vehicle tank to be filled or a permissible gas quantity in the vehicle tank. The expert is familiar with the methods for determining such parameters.

For the purposes of the present invention, the term "fill" is not to be understood so that all necessary steps included in the method therefor must be carried out automatically. Rather, the term "fill" may also be understood to mean that the vending system makes all the necessary steps such as releasing the correct gas supply line, opening the valves, measuring the pressure and/or gas flow and terminating the process on the system side. External measures, such as connecting the vending system to the vehicle tank may still have to be performed by the customer, regardless of the method according to the invention, even if a fully automatic system is conceivable and is included within the terms of the invention.

For example, the volume of gas released may be a volume that is determined by the customer.

The filled gas bottle may preferably be a gas bottle that is held in readiness in a reservoir, for example in the reservoir according to the invention described previously.

The filled gas bottle may also be a gas bottle that the customer has supplied empty. This variation of the method according to the invention is thus a simple exchange or deposit system. Both options may operate in tandem, for example it is possible to issue filled gas bottles first until the reserve is exhausted, and only then to resort to refilling the empty bottles supplied.

The dispensing of a filled gas bottle preferably includes the following substeps:

automatic determination whether a new gas bottle is needed in order to distribute the gas selected by the customer, based on the result of the evaluation, selection of at least one of the following actions: a) refill of a gas bottle provided by the customer, b) provision of an empty gas bottle from a bottle reservoir in the vending system, c) filling of an empty gas bottle provided from the reservoir, d) storage of a gas bottle supplied by the customer, e) issue of a previously filled gas bottle from the reservoir, and f) rejection of a non-conforming gas bottle.

This automatic evaluation may depend on a variety of factors. These factors include, without limitation thereto: the type and quantity of the gas chosen by the customer, (if more than one gas can be dispensed), the type of empty bottle made available, the type of bottle required, the condition of the bottle (leaks etc.), the amount of gas still available (if a gas tank is being used), the number of empty and full bottles in the reservoir etc.

The actions include those indicated above, without being restricted thereto. In addition, it is not necessary that all the above listed actions can be performed in a given vending system according to the invention. Depending on the vending system employed, a subset of the above actions is also suitable to achieve the functionality of the vending station and its filling station. The actions may also be combined, if necessary.

If for certain reasons a new gas bottle is required, this gas bottle, if available, may be taken from the reservoir, for example. This gas bottle may be either a prefilled or an empty bottle, depending on the capabilities and the design of the vending system according to the invention, and on the evaluation process (number of stored bottles, gas remaining in the tank, type of gas bottle etc.).

Depending on the substantive embodiment in a particular vending system, a gas bottle provided from the reservoir may also be filled with gas automatically. Alternatively, in certain embodiments, the customer may be directed to transfer the bottle to the filling station for refilling.

Figure 2:
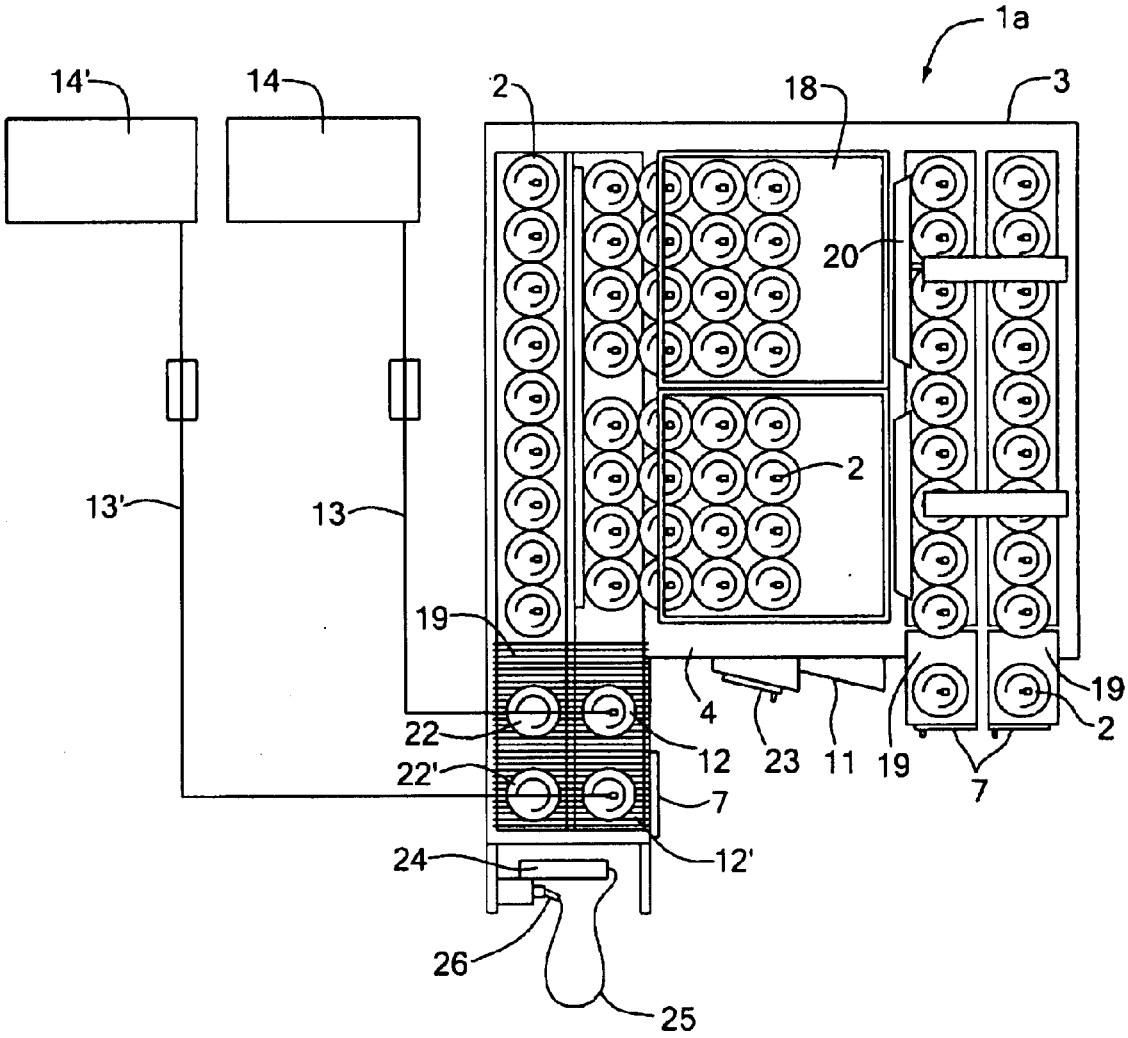

In the following the invention will be explained in more detail on the basis of specific embodiments and with reference to the drawing, in which:

FIG. 1 shows a first embodiment of a vending system according to the present invention, in which a reservoir with bottles is implemented; and FIG. 2 shows a second embodiment of a vending system according to the present invention, in which a gas tank and a return system is provided in addition to the facilities shown in FIG. 1.

FIG. 1 shows a schematic representation of a vending machine 1*a* according to the invention having a housing 3 that defines an interior space 4. A series of gas bottles 2 are arranged on transport disposal means 18, and may be shifted with the aid of a shifting device 20 from disposal means 18 and onto a transporter, which transports them to the actual filling station 12. Filling station 12 is connected to tank 14 via a gas pipe 13 in which a pump may be mounted, and which together form the gas supply line. It is equally possible to connect gas pipe 3 directly to a gas supply enterprise. The gas supply line enables filling of empty gas bottles 2 in filling station 12, which are delivered via a bottle output point 7 in filling station 12 and may be removed therefrom when they have been filled. A control unit controls the filling operation for gas bottles (not shown), which can be operated either by the customer and/or service personnel via a control panel 11.

A further essential feature of the invention is also the provision of a filling device for filling vehicle gas tanks, which for example, as shown, has a flow control unit 24 that is connected to gas pipe 13 and the control means, a gas supply 25 that is connected to flow control unit 24 and a filling pipe 26 connected to gas supply 25, which is adapted to fit an inlet valve on a vehicle gas tank. The filling pipe may for example have a bayonet connection.

Further elements of this substantive embodiment which are intended for exemplary description, are an additional transport conveyor 19 which serves to remove defective gas bottles 2, which have been isolated by the control unit, and are placed in a special area of the reservoir, from where they can be removed later.

In addition, a mechanism for dispensing accessories 23 is shown schematically, from which the customer may obtain needed accessories such as protective caps for valves or similar.

The main area of the reservoir with the transport disposal means may be filled with empty bottles, but also with full bottles 2.

The gas vending system according to the invention may also be arranged for the sale of more than one gas. One example of such an embodiment is shown schematically in FIG. 2. The same elements of the device are provided with the same reference numbers as in FIG. 1.

The vending system of FIG. 2 has a second gas supply line 13', which is connected to another tank 14'. This tank 14' may contain the same gas as tank 14, for example so that it can meet a high demand at a certain point of sale, or it may contain another gas.

The operation of the vending system according to this embodiment corresponds to the operation system shown in FIG. 1, except that in this case customers may also select a second gas.

Each of transporters 19 on the right side of FIG. 2 may be filled with bottles 2 that are filled with different gases. If a problem arises with a bottle 2 supplied by the customer (a leak, for example), this will be withdrawn from circulation and the customer may take a gas bottle with the desired gas from one of the reception points 7 on the right side of FIG. 2, which can be automatically unlocked by the control means.

Of course, a larger number of different gases may be provided in multiple tanks.

In the event that a defect is detected in one of the bottles at filling station 12, the bottle may be transported to the rear, where the remaining gas is evacuated by means of an extraction station 22, 22' before the bottle is stored in the reservoir.

What is claimed is:

1. A vending system (1, 1*a*) for gases having a filling station (12) for filling gas bottles (2) with at least one gas, at least one gas supply line (3) connected to filling station (12), and control means for control of a gas distribution, characterised in that a filling mechanism is further provided for filling gas tanks in vehicles, which is also connected to the at least one gas supply line (3), and that is also controlled by the control means.

2. The vending system according to claim 1, characterised in that the at least one gas supply means is a gas pipe that connects the vending system to a gas supplier.

3. The vending system according to claim 1, characterised in that the gas supply means is a gas tank (4) that is connected with the filling station.

4. The vending system according to claim 1, characterised in that the filling mechanism comprises:

a flow control unit (24) that is connected to the gas supply means and the control means, a supply line (25) that is connected to flow control unit (24), and a filler pipe (26) that is connected to supply line (25), and that is adapted to fit an inlet valve of the gas tank of a vehicle.

5. The vending system according to claim 4, characterised in that supply line (25) is a hose suitable for transporting gas.

6. The vending system according to claim 1, characterised in that it is also equipped with a reservoir for gas bottles (2), from which gas bottles (2) may be removed under access control and/or to which gas bottles (2) may be returned, preferably under access control.

7. The vending system according to claim 6, characterised in that for control of access to the reservoir and/or to filling station (12), an image recognition device is provided, and/or at least one sensor which cooperates with a bottle identifier on the bottle, for example a chip, a transponder, or a bar or color coding of the bottle.

8. The vending system according to claim 6, characterised in that filling station (12) is provided outside the reservoir.

9. The vending system according to claim 6, characterised in that reservoir is configured to include at least one transport disposal device (18) for gas bottles and is provided with means for removing gas bottle from and/or placing gas bottles on the transport disposal device.

10. The vending system according to claim 9, characterised in that transport disposal devices (18) are pallets, magazines, containers or container-like devices.

11. The vending system according to claim 6, characterised in that a reception system is provided in the reservoir having a plurality of reception points, each for one gas bottle, and that each reception point is movable to an issue (7) and/or a return point for a gas bottle.

12. The vending system according to claim 1, characterised in that the control means controls or can control at least one issue point (7) and one return point.

13. The vending system according to claim 1, characterised by means for automatic filling of gas bottles (2).

14. A method for distributing gases with a vending system having a filling station (12) for gases and a filling device for filling of vehicle gas tanks, including the following steps determine whether a customer wants to buy gas in bottles (2) or gas for a tank;

if the customer wants to buy gas for a vehicle tank:

fill the vehicle tank up to a technical limit or up to a predetermined amount;

if the customer wants to buy gas in gas bottles:

issue a filled gas bottle (2).

15. The method according to claim 14, characterised in that the technical limit is a permissible gas pressure in the vehicle tank to be filled.

16. The method according to claim 15, characterised in that the technical limit is a permissible volume of gas in the vehicle tank.

17. The method according to claim 14, characterised in that the predetermined dispensing quantity is a quantity determined by the customer.

18. The method according to claim 14, characterised in that the filled gas bottle (2) is a gas bottle (2) that is held in readiness in a reservoir.

19. The method according to claim 14, characterised in that the filled gas bottle (2) is a gas bottle (2) that the customer has supplied empty.

20. The method according to claim 14, characterised in that the filled gas bottle (2) is dispensed in accordance with the following substeps:

Automatic evaluation, whether a new gas bottle (2) for the distribution is necessary for the customer's chosen gas, based on the evaluation result, selection of at least one of the following actions: a) refill of a gas bottle (2) supplied by the customer, b) provision of an empty gas bottle (2) from a bottle reservoir in vending system (1, 1*a*), c) filling of an empty gas bottle (2) provided from the reservoir, d) storage of a gas bottle (2) supplied by the customer, e) issue of a previously filled gas bottle (2) from the reservoir, and f) rejection of a non-conforming gas bottle (2).

* * * * *